US011715610B2

(12) United States Patent
Postmus

(10) Patent No.: US 11,715,610 B2
(45) Date of Patent: Aug. 1, 2023

(54) OPERATING MECHANISM FOR OPERATING AT LEAST ONE CONTACT

(71) Applicant: Eaton Intelligent Power Limited, Dublin (IE)

(72) Inventor: Albert Postmus, Goor (NL)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/520,814

(22) Filed: Nov. 8, 2021

(65) Prior Publication Data

US 2022/0148823 A1 May 12, 2022

(30) Foreign Application Priority Data

Nov. 10, 2020 (GB) ..... 2017721

(51) Int. Cl.
*H01H 3/42* (2006.01)
*H01H 3/30* (2006.01)
*H01H 33/664* (2006.01)

(52) U.S. Cl.
CPC ..... *H01H 3/42* (2013.01); *H01H 3/3015* (2013.01); *H01H 33/664* (2013.01)

(58) Field of Classification Search
CPC ..... H01H 3/42; H01H 3/3015; H01H 3/60; H01H 33/664; H01H 33/666; H01H 33/42; H01H 2033/6667; H01H 3/3026; H01H 3/3042; H01H 3/38
USPC ..... 200/400, 416, 431, 438, 428, 432
See application file for complete search history.

(56) References Cited

U.S. PATENT DOCUMENTS 3,729,065 A * 4/1973 Baskerville ..... H01H 3/30 200/558
6,917,006 B2 * 7/2005 Bachofen ..... H01H 3/3052 200/318.2
8,124,901 B2 * 2/2012 Toba ..... H01H 3/30 200/501
8,481,880 B2 * 7/2013 Bottcher ..... H01H 3/3047 218/154
8,642,907 B2 * 2/2014 Slepian ..... H01H 71/50 200/468
8,816,802 B2 * 8/2014 Freimuth ..... H01H 3/3031 335/73

(Continued)

FOREIGN PATENT DOCUMENTS

GB 2557582 A 6/2018
WO WO 2018115026 A1 6/2018

*Primary Examiner* — William A Bolton
(74) *Attorney, Agent, or Firm* — Leydig, Voit & Mayer, Ltd.

(57) ABSTRACT

An operating mechanism for operating at least one contact is provided. The operating mechanism includes a base frame and an operating rod that is linearly guided in the base frame for connection with at least one contact. The operating mechanism further includes a contact spring for urging the operating rod to the open position and a rod mechanism having two links, and each link has a first end and a second end. The operating mechanism also includes a cam follower arranged at the middle hinge of the rod mechanism, a cam arranged on a cam shaft, a cam shaft lock for lacking the shaft, and a closing spring. The opening section of the cam is configured such that the cam follower follows the profile of the opening section when the operating rod moves from the closed position towards the open position.

12 Claims, 4 Drawing Sheets

(56) References Cited

U.S. PATENT DOCUMENTS

| | | | | |
|---|---|---|---|---|
| 9,373,456 | B2 * | 6/2016 | Yang | H01H 3/42 |
| 9,704,661 | B2 * | 7/2017 | Chen | H01H 3/26 |
| 10,533,978 | B2 * | 1/2020 | Benke | G01N 29/46 |
| 2012/0125752 | A1 * | 5/2012 | Yamamoto | H01H 33/40 200/469 |
| 2018/0211796 | A1 * | 7/2018 | Kalin | H01H 3/3031 |

* cited by examiner

OPERATING MECHANISM FOR OPERATING AT LEAST ONE CONTACT

CROSS-REFERENCE TO PRIOR APPLICATION

Priority is claimed to British Patent Application No. GB 2017721.8, filed on Nov. 10, 2020, the entire disclosure of which is hereby incorporated by reference herein.

FIELD

The invention relates to an operating mechanism for operating at least one contact, such as a vacuum interrupter.

BACKGROUND

With an operating mechanism, a contact can be closed and opened quickly. The closing spring aids in providing a counter force against the contact spring, such that the cam shaft can be rotated quickly and the contact can be closed within a sufficient short time period.

In order to open the contact, the cam shaft is released such that the contact spring can push open the contact and bring the operating rod towards the open position. In order to have a sufficient quick opening of the contact, the strength of the contact spring can be increased. This however results in a substantial acceleration and thus speed of the operating rod when moving from the closed position to the open position.

When the operating rod reaches the open position with high speed, the operating rod will bounce back and the contacts are moved again towards each other, which could lead to undesired sparking.

SUMMARY

In an embodiment, the present invention provides an operating mechanism for operating at least one contact, wherein the operating mechanism comprises: a base frame; an operating rod linearly guided in the base frame for connection with at least one contact, wherein the operating rod has a closed position and an open position; a contact spring for urging the operating rod to the open position; a rod mechanism of two links, each having a first end and a second end, wherein the first ends are hinged to each other at a middle hinge, wherein the second end of one link is hinging with the base frame and the second end of the other link is hinging with the operating rod; a cam follower arranged at the middle hinge of the rod mechanism; a cam arranged on a cam shaft, wherein the cam abuts the cam follower and the cam has a profile with, in rotational direction, a closing section, an opening section and an idle-section; a cam shaft lock for locking the shaft at a rotational position where the cam follower abuts the cam at the end of the closing section; and a closing spring arranged between a crank arranged to the cam shaft and the base frame, wherein the closing spring relaxes when the cam follower runs over the closing section towards the opening section and wherein the closing spring has a pretension, when the cam shaft is in the locked position, wherein the profile of the opening section is configured such that the cam follower follows the profile of the opening section when the operating rod moves from the closed position towards the open position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
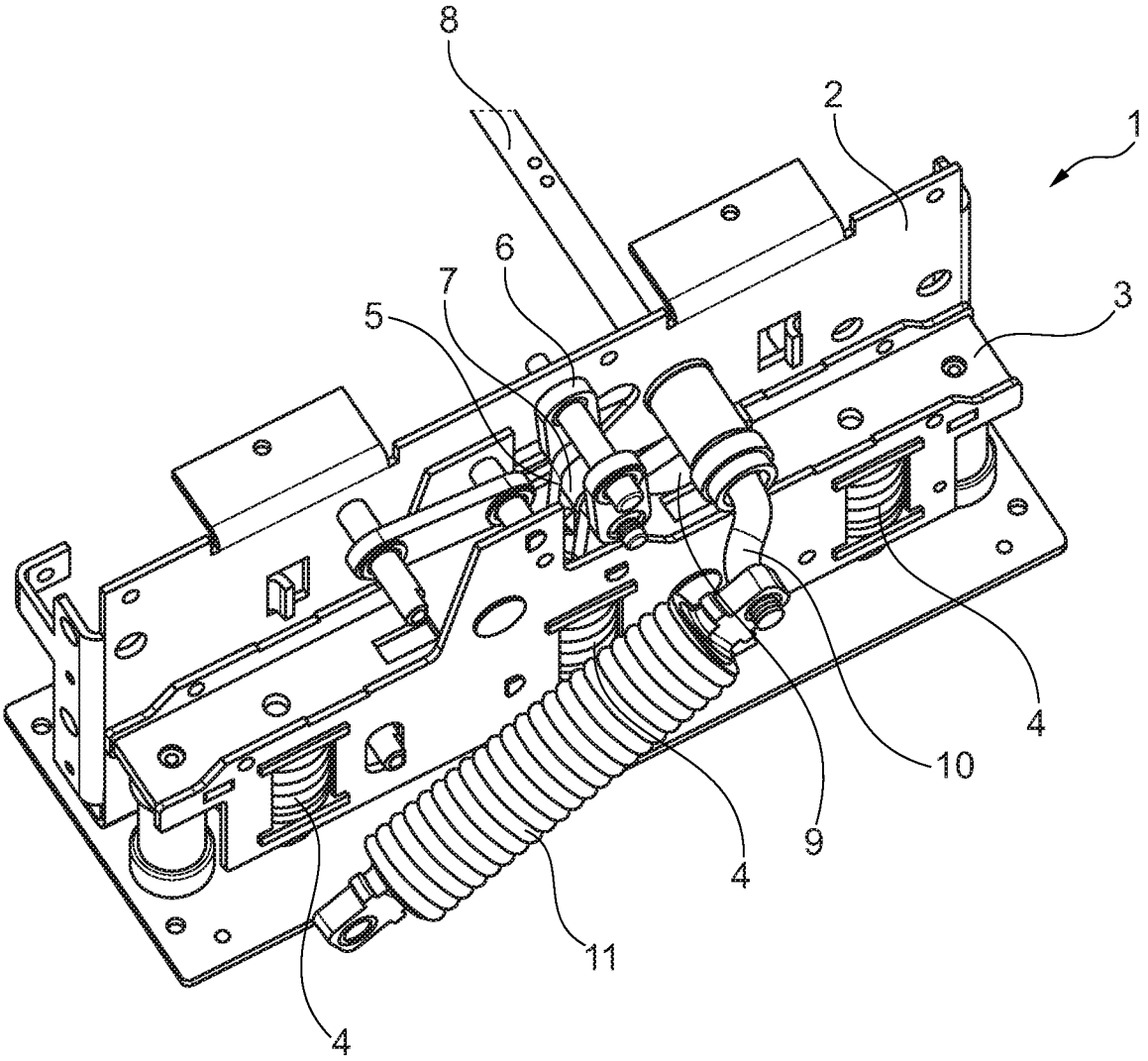
FIG. 1 shows a perspective view of an embodiment of an operating mechanism according to the invention.

In an embodiment, the present invention reduces or removes the above-mentioned disadvantages.

In an embodiment, the present invention provides an operating mechanism, which is characterized in that the profile of the opening section is designed such that the cam follower follows the profile of the opening section when the operating rod moves from the closed position towards the open position.

In an embodiment, the present invention relates to an operating mechanism for operating at least one contact, such as a vacuum interrupter, which the operating mechanism comprises:

- a base frame;
- an operating rod linearly guided in the base frame for connection with at least one contact, which operating rod has a closed position and an open position;
- a contact spring for urging the operating rod to the open position;
- a rod mechanism of two links each having a first end and a second end, wherein the first ends are hinged to each other at a middle hinge, wherein the second end of one link is hinging with the base frame and the second end of the other link is hinging with the operating rod;
- a cam follower arranged at the middle hinge of the rod mechanism;
- a cam arranged on a cam shaft, wherein the cam abuts the cam follower and the cam has a profile with, in rotational direction, a closing section, an opening section and an idle-section;
- a cam shaft lock for locking the shaft at a rotational position where the cam follower abuts the cam at the end of the closing section;
- a closing spring arranged between a crank arranged to the cam shaft and the base frame, wherein the closing spring relaxes when the cam follower runs over the closing section towards the opening section and wherein the closing spring has a pretension, when the cam shaft is in the locked position.

In an embodiment, with the operating mechanism according to the invention, the opening movement of the operating rod and accordingly the movement of the cam follower is controlled. This ensures that any undesired movements can be counteracted directly. To this end, the closing spring is provided. When a bouncing of the operating rod would cause the cam follower to move in the other direction, the cam would also be urged to counter rotate. This counter rotation will cause the closing spring to tension and this will damp the bouncing effect of the operating rod.

In an embodiment of the operating mechanism according to the invention the closing spring is pretensioned to urge the cam in contact with the cam follower at least when the operating rod moves from the closed position towards the open position.

The pretension in the closing spring will urge the crank and accordingly the cam shaft to rotate and cause the cam with the opening profile in contact with cam follower during the opening movement of the operating rod.

In an embodiment of the operating mechanism according to the invention the path of the cam follower coincides or partially intersects with the opening section, when the cam follower contacts the cam at the transition from the closing section and the opening section.

This ensures that at the moment the operating rod starts to move from the closed position towards the open position, the cam follower can freely move along the opening section, or, in case the path partially intersects with the opening section, needs to slightly push the cam in counter rotation against the tension of the closing spring. This ensures a reliable contact between the cam follower and the cam during the opening movement and will counteract any bouncing of the contacts.

In another embodiment of the operating mechanism according to the invention the cam follower urges the cam in counter rotational direction, when the operating rod moves from the closed to the open position.

As the closing spring acts on the crank and thus via the cam shaft on the cam, there is some force counter acting the opening movement of the operating rod and this will dampen any undesired movements.

In a preferred embodiment of the operating mechanism according to the invention the profile of the opening section is concave up. Preferably, the profile of the closing section and the idle-section are concave down.

A profile is said to be concave up on a section if the graph of the function is above the tangent at each point of the section. A profile is said to be concave down on a section if the graph of the function is below the tangent at each point of the section.

As the movement of the cam follower is along a circular path, the cam follower can freely move when the cam follower reaches the transition from the closing section to the opening section. The concave up opening section allows for the cam follower to more or less move freely, without any substantial rotation of the cam shaft. This allows for a controlled opening movement.

In an embodiment, the invention also relates to a method for operating at least one contact, such as a vacuum interrupter, comprising the steps of:

- providing an operating mechanism according to the invention;
- turning the cam shaft, wherein the closing section of the cam contacts the cam follower and pushes the cam follower away from the cam shaft, such that the operating rod is moved to the closed position and the tension in the closing spring is released until a first pre-set tension;
- locking the cam shaft with the cam shaft lock;
- releasing the cam shaft and letting the first pre-set tension of the closing spring to rotate the cam shaft further, such that the cam follower reaches the opening section of the cam;
- allowing the contact spring to move the operating rod towards the open position, while maintaining contact between the cam follower and the cam;
- when the operating rod is in the open position rotating the cam shaft further to retension the closing spring and positioning the cam with the transition from the idle-section to the closing section in contact with the cam follower.

FIG. 1 shows a perspective view of an embodiment of an operating mechanism 1 according to the invention. The operating mechanism 1 has a base frame 2 with an operating rod or bridge 3 to operate simultaneously three contacts, which are each provided with a contact spring 4.

A rod mechanism consisting out of two links 5, 6 is provided arranged between the base frame 2 and the bridge 3. A cam follower 7 is provided between the two links 5, 6 at the mutual hinge.

A cam shaft 8 is arranged rotatably in the base frame 2. A cam 9 is arranged on the cam shaft 8 and the cam 9 is in contact with the cam follower 7. The cam shaft 8 has on an end a crank 10 to which a closing spring 11 is arranged.

Figure 2:
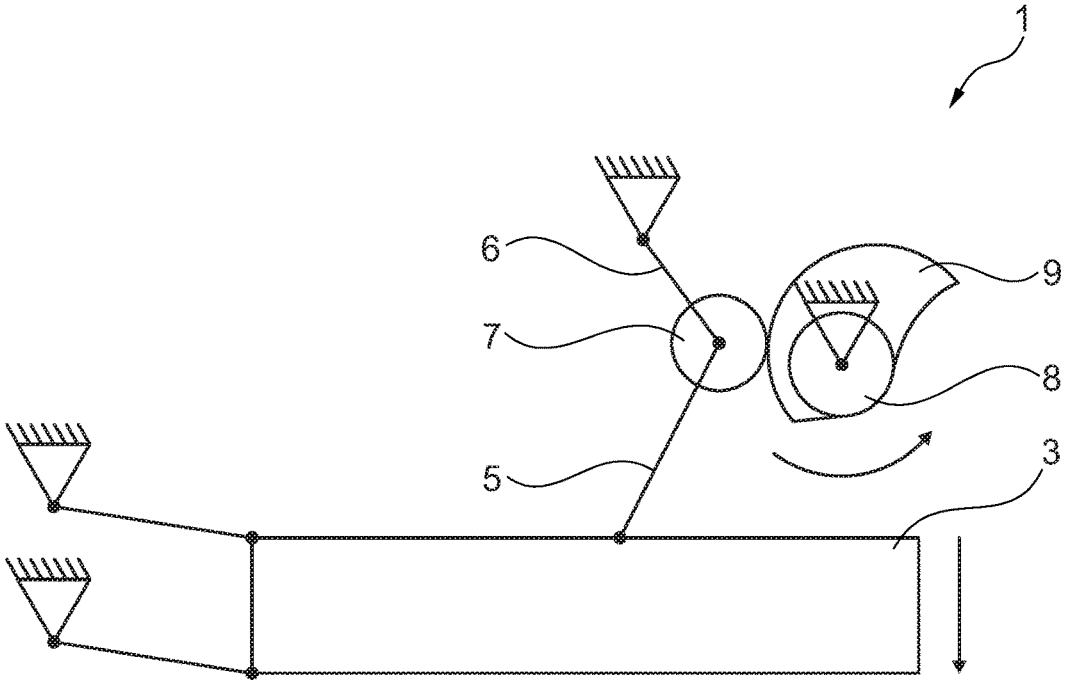
FIG. 2 shows a schematic view of the embodiment of FIG. 1 in a closing position.

FIG. 2 shows a schematic view of the operating mechanism 1 of FIG. 1. By rotating the cam shaft 8, the cam 9 pushes the cam follower 7, such that the links 5, 6 "stretch" and the bridge 3 is moved down to close one or more contacts.

Figure 3:
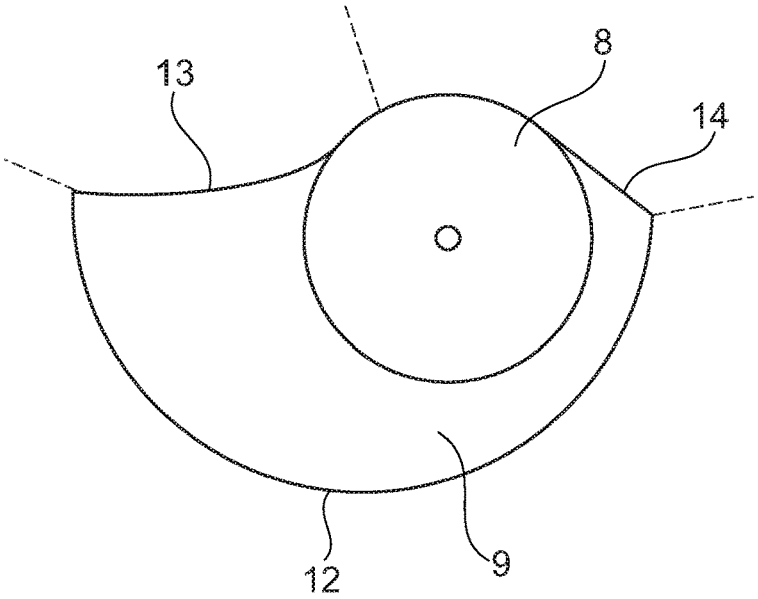
FIG. 3 shows a detailed view of the cam of the embodiment of FIG. 1.

FIG. 3 shows the cam 9 in more detail. The outer profile of the cam 9 has three sections: a closing section 12, an opening section 13 and an idle-section 14.

Figure 4:
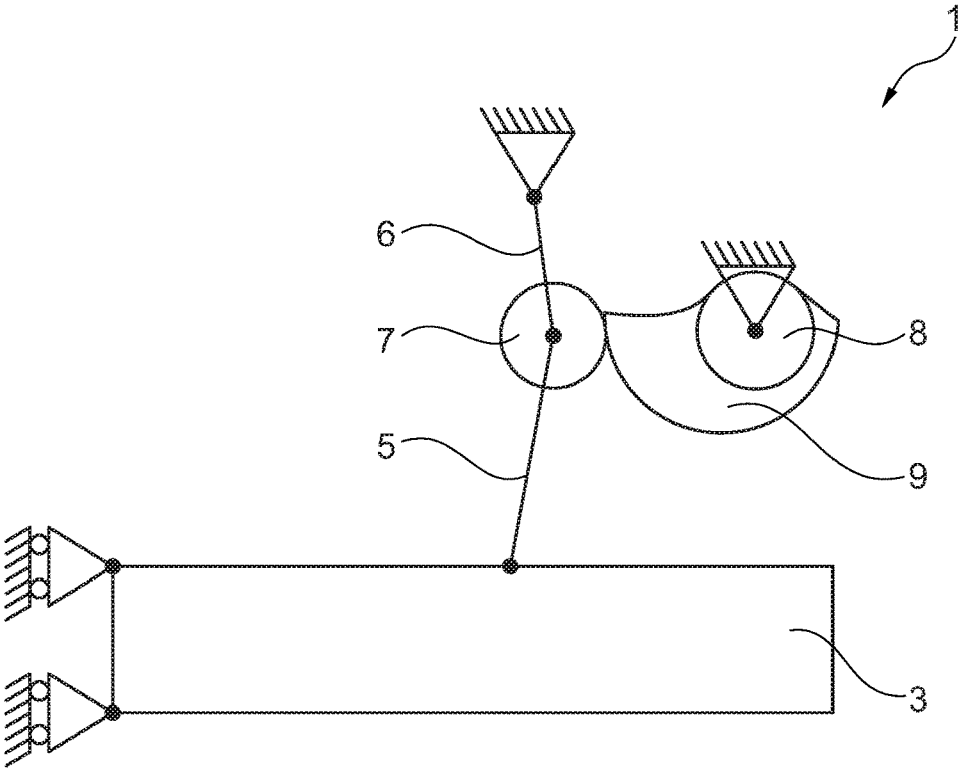
FIGS. 4-6 show a schematic view of the embodiment of FIG. 1 in different positions.

FIG. 4 shows the operating mechanism 1 in closed position, where the cam follower 7 contacts the cam 9 at the end of the closing profile 10. In this position the cam shaft 8 is locked by a cam shaft lock.

Figure 5:
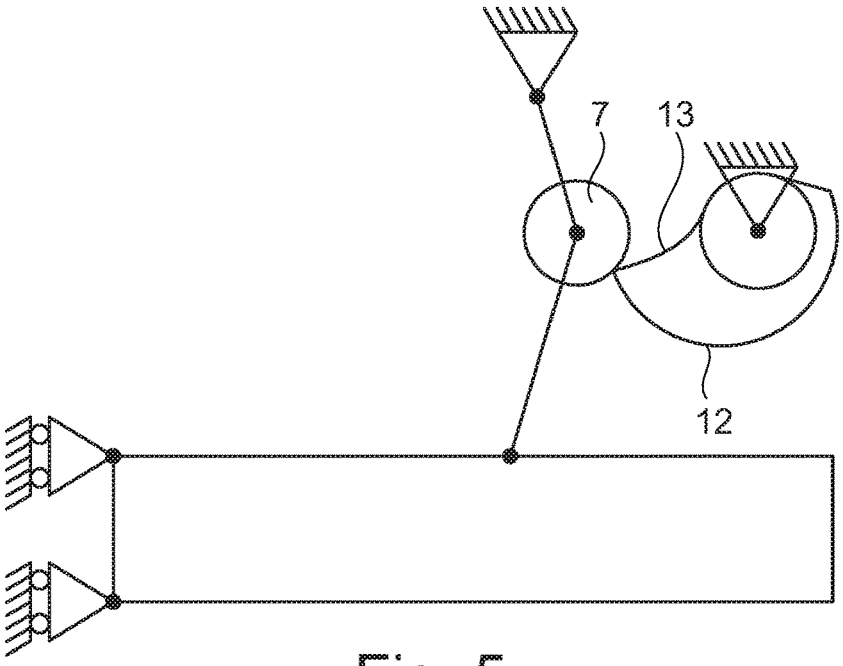
Figure 7:
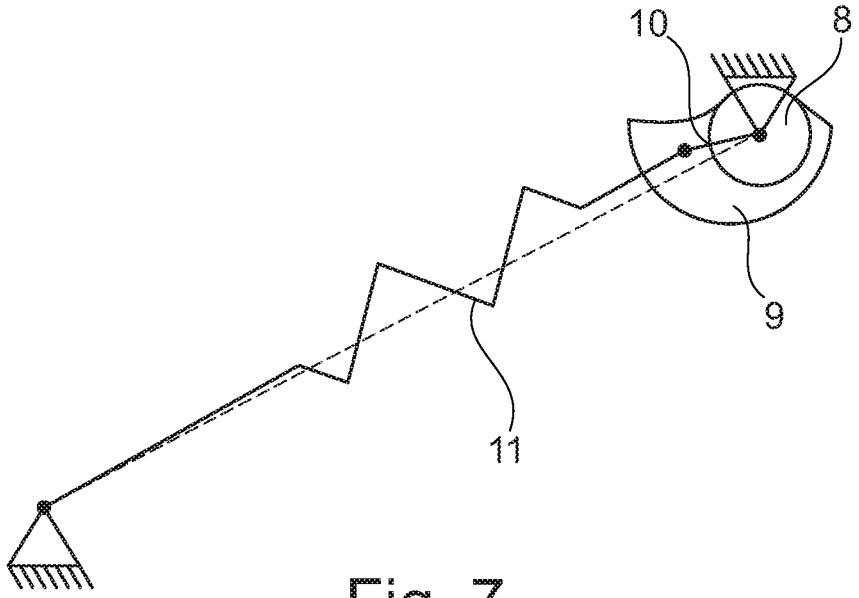
FIG. 7 shows a schematic view of the closing spring of the embodiment of FIG. 1.

When the contacts need to open, for example as a result of a short-circuit or the like, the cam shaft lock is released and the closing spring 11, which is under some residual tension and because the crank 10 is not yet aligned with the closing spring 11 (as shown in FIG. 7), the cam shaft 8 will be rotated to the position, where the cam follower 7 passes the transition of the closing section 112 and the opening section 13, as shown in FIG. 5.

Figure 6:
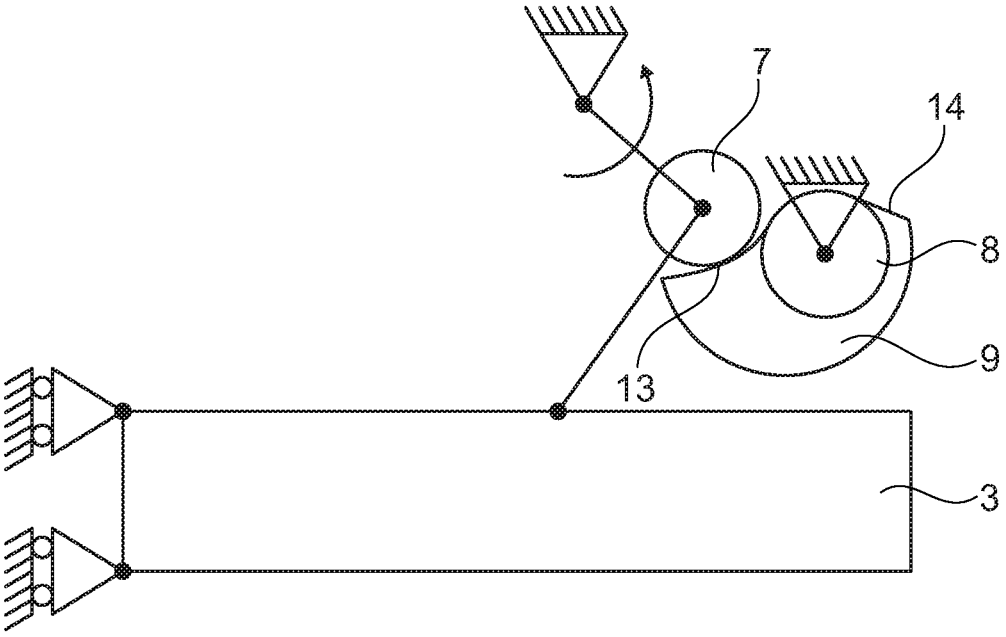

At this moment, the cam follower 7 is free to move along its path and along the concave up opening section of the profile, as shown in FIG. 6.

When the bridge 3 would bounce back, the cam follower 7 is withheld by the concave up opening section 13 of the cam 9. Only by rotation in counter direction of the cam shaft 8, which will tension the closing spring will allow for movement back of the cam follower 7 and the bridge 3, but this will dampen the undesired movement.

After the opening movement is completed, the cam shaft 8 can be rotated further, where the cam follower 7 rolls over the idle-section 14, which does not impose any displacement of the cam follower 7, but will tension the closing spring 11 to a maximum, such that the closing spring 11 can cause the closing movement, when the cam shaft is rotated to the position shown in FIG. 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An operating mechanism for operating at least one contact, wherein the operating mechanism comprises:

a base frame;

an operating rod linearly guided in the base frame for connection with at least one contact, wherein the operating rod has a closed position and an open position;

a contact spring for urging the operating rod to the open position;

a rod mechanism of two links, each having a first end and a second end, wherein the first ends are hinged to each other at a middle hinge, wherein the first ends are configured to rotate relative to one another about the middle hinge, wherein the second end of one link is hinging with the base frame and the second end of the other link is hinging with the operating rod, the second end of the other link being configured to rotate about the operating rod;

a cam follower arranged at the middle hinge of the rod mechanism;

a cam arranged on a cam shaft, wherein the cam abuts the cam follower and the cam has a profile with, in rotational direction, a closing section, an opening section and an idle-section;

a cam shaft lock for locking the shaft at a rotational position where the cam follower abuts the cam at an end of the closing section; and a closing spring arranged between a crank arranged to the cam shaft and the base frame, wherein the closing spring relaxes when the cam follower runs over the closing section towards the opening section and wherein the closing spring has a pretension, when the cam shaft is in a locked position, wherein the profile of the opening section is configured such that the cam follower follows the profile of the opening section when the operating rod moves from the closed position towards the open position.

2. The operating mechanism according to claim 1, wherein the closing spring is pretensioned to urge the cam in contact with the cam follower at least when the operating rod moves from the closed position towards the open position.

3. The operating mechanism according to claim 1, wherein a path of the cam follower coincides or partially intersects with the opening section, when the cam follower contacts the cam at a transition from the closing section and the opening section.

4. The operating mechanism according to claim 1, wherein the cam follower urges the cam in counter rotational direction, when the operating rod moves from the closed to the open position.

5. The operating mechanism according to claim 1, wherein the profile of the opening section is concave up.

6. The operating mechanism according to claim 5, wherein the profile of the closing section and the idle-section are concave down.

7. The operating mechanism according to claim 5, wherein a graphical representation of a function corresponding to the profile of the opening section is such that the function is above a tangent line at any given point within the function.

8. The operating mechanism according to claim 1, wherein the at least one contact is a vacuum interrupter.

9. The operating mechanism according to claim 1, wherein the profile of the cam is coincident with a profile of the cam shaft where the opening section transitions to the idle-section.

10. The operating mechanism according to claim 1, wherein the profile of the cam comprises only one opening section.

11. A method for operating at least one contact, comprising the steps of:

turning a cam shaft of an operating mechanism, wherein the operating mechanism comprises a base frame, an operating rod having a closed position and an open position, a contact spring, a rod mechanism of two links, a cam follower, a cam arranged on the cam shaft, a cam shaft lock, and a closing spring, wherein a closing section of the cam contacts the cam follower and pushes the cam follower away from the cam shaft, such that:

the two links of the rod mechanism are rotated relative to one another closer to a collinear arrangement relative to one another, an end of one of the two links of the rod mechanism rotates about the operating rod, the operating rod is moved to the closed position, and a tension in the closing spring is released until a first pre-set tension;

locking the cam shaft with the cam shaft lock;

releasing the cam shaft and letting the first pre-set tension of the closing spring to rotate the cam shaft further, such that the cam follower reaches an opening section of the cam;

allowing the contact spring to move the operating rod towards the open position, while maintaining contact between the cam follower and the cam; and when the operating rod is in the open position, rotating the cam shaft further to retension the closing spring and positioning the cam with a transition from an idle-section to the closing section in contact with the cam follower.

12. The method according to claim 11, wherein the at least one contact is a vacuum interrupter.

* * * * *